US008985824B2

(12) United States Patent
Ito et al.

(10) Patent No.: US 8,985,824 B2
(45) Date of Patent: Mar. 24, 2015

(54) AUTOMOTIVE LAMP HAVING FAN

(75) Inventors: Masayasu Ito, Shizuoka (JP); Tsukasa Tokida, Shizuoka (JP)

(73) Assignee: Koito Manufacturing Co., Ltd., Minato-Ku, Tokyo (JP)

( * ) Notice: Subject to any disclaimer, the term of this patent is extended or adjusted under 35 U.S.C. 154(b) by 120 days.

(21) Appl. No.: 12/508,512

(22) Filed: Jul. 23, 2009

(65) Prior Publication Data

US 2010/0020563 A1 Jan. 28, 2010

(30) Foreign Application Priority Data

Jul. 24, 2008 (JP) ..... 2008-191370

(51) Int. Cl.

| | |
|---|---|
| ***F21S 8/10*** | (2006.01) |
| ***F21V 29/02*** | (2006.01) |
| *F21W 101/10* | (2006.01) |
| *F21Y 101/02* | (2006.01) |

(52) U.S. Cl.

CPC ..... *F21S 48/325* (2013.01); *F21S 48/1154* (2013.01); *F21S 48/1159* (2013.01); *F21S 48/335* (2013.01); *F21V 29/02* (2013.01); *F21W 2101/10* (2013.01); *F21Y 2101/02* (2013.01)

USPC ..... 362/547; 362/542; 362/544; 362/545

(58) Field of Classification Search

USPC ..... 362/547, 543, 544, 545

See application file for complete search history.

(56) References Cited

U.S. PATENT DOCUMENTS

| | | | | |
|---|---|---|---|---|
| 6,619,828 | B2 * | 9/2003 | Montet et al. | 362/539 |
| 7,114,837 | B2 * | 10/2006 | Yagi et al. | 362/523 |
| 7,427,152 | B2 * | 9/2008 | Erion et al. | 362/547 |
| 7,621,664 | B2 * | 11/2009 | Nicolai | 362/547 |
| 7,806,572 | B2 * | 10/2010 | McFadden et al. | 362/538 |
| 7,821,123 | B2 * | 10/2010 | Oman | 257/706 |
| 2006/0076572 | A1 * | 4/2006 | Huber et al. | 257/99 |

(Continued)

FOREIGN PATENT DOCUMENTS

| | | | |
|---|---|---|---|
| DE | 2004 017454 | A1 | 1/2005 |
| DE | 2004 025623 | A1 | 12/2005 |

(Continued)

OTHER PUBLICATIONS

Notification of Reasons for Refusal, Sep. 4, 2012, 3 pages.

(Continued)

*Primary Examiner* — Jong-Suk (James) Lee
*Assistant Examiner* — Mark Tsidulko
(74) *Attorney, Agent, or Firm* — Buchanan Ingersoll & Rooney PC

(57) ABSTRACT

An automotive lamp is provided with: a lamp chamber formed so as to include a lamp body having a front end opening portion and a translucent cover provided on the lamp body so as to cover the front end opening portion; a lamp unit that is housed inside the lamp chamber and includes a semiconductor light emitting device as a light source; a bracket that includes a light source mounting portion having a mounting surface for the semiconductor light emitting device and a plurality of radiating fins, thermally in contact with the light source mounting portion and arranged such that ventilation passages extend from the lamp body side toward the translucent cover, are formed, and that supports the lamp unit; and a fan that blows air such that air flows through the ventilation passages from the lamp body side toward the translucent cover.

9 Claims, 5 Drawing Sheets

(56) References Cited

U.S. PATENT DOCUMENTS

| | | | | |
|---|---|---|---|---|
| 2007/0091632 | A1 | 4/2007 | Glovatsky et al. | |
| 2008/0144329 | A1 * | 6/2008 | Okuda | 362/539 |

FOREIGN PATENT DOCUMENTS

| | | | | |
|---|---|---|---|---|
| DE | 2006 051030 | A1 | 5/2007 | |
| DE | 2007 028301 | A1 | 12/2007 | |
| DE | 2006 037481 | A1 | 2/2008 | |
| DE | 2005 060736 | A1 | 7/2010 | |
| JP | 2005337118 | * | 5/2004 | F04D 29/30 |
| JP | 2007-035335 | | 8/2007 | |
| JP | 2007214116 | A | 8/2007 | |
| JP | 2007/242292 | | 9/2007 | |
| JP | 2008060031 | A | 3/2008 | |
| WO | 2007/073721 | A1 | 5/2007 | |

OTHER PUBLICATIONS

English translation of Office Action dated Jun. 9, 2010, regarding corresponding Chinese Patent Application 2009/10160147.6.

* cited by examiner

10

10

10

AUTOMOTIVE LAMP HAVING FAN

CROSS-REFERENCE TO RELATED APPLICATION

This application is based upon and claims the benefit of priority from the prior Japanese Patent Application No. 2008-191370, filed on Jul. 24, 2008, the entire contents of which are incorporated herein by reference.

BACKGROUND

Recently, automotive lamps that use, as a light source, a semiconductor light emitting device such as an LED (light emitting diode) or the like, have been known. When a semiconductor light emitting device is used as a light source for an automotive lamp, the level of light intensity required of the automotive lamp must be satisfied by a maximum use of the light emission from the semiconductor light emitting device.

Generally, a semiconductor light emitting device produces more heat for larger current which is supplied to obtain a greater output. And this correspondingly lowers the luminance efficiency of the semiconductor light emitting device as it gets hotter due to the heating. Thus, there have been various heat radiation structures known for automotive lamps in order to radiate heat from the semiconductor light emitting device efficiently.

For example, in Japanese Patent Application Publication No. 2007-35335, an automotive lamp including a housing whose front end is open, a front lens closing the front end opening portion, a light source unit having a semiconductor light emitting device, a heatsink in contact with the light source unit, and a windmill fan, is disclosed. In the automotive lamp, the windmill fan is rotated by the wind occurring while an automobile is moving and an airflow occurring due to the rotation of the windmill fan flows near the heatsink to cool the heatsink. Thereby, the efficiency in radiating the heat from the semiconductor light emitting device is improved.

A light radiated by a semiconductor light emitting device hardly produces so-called radiation heat effect. Therefore, there is a problem that, when a light from a semiconductor light emitting device is radiated forwards through a translucent cover that covers a front end opening portion of a lamp body, the translucent cover is hardly warmed, and accordingly snow or ice adhered to the outer surface of the translucent cover hardly melts.

To solve the problem, it can be considered that a heat source such as a heater or the like is provided to prevent the adhesion of snow or ice to the outer surface of the translucent cover. However, this measure is not preferable because installation of a heater increases a production cost and needs power for increasing the temperature of the heater. On the other hand, it can be considered that the heat produced by the semiconductor light emitting device is used for preventing the adhesion of snow or ice to the translucent cover. This measure is preferable in terms of power saving and cost.

In the automotive lamp disclosed in the Japanese Patent Application Publication No. 2007-35335, the front lens is slightly warmed because the heat in the heatsink is radiated into the whole air inside the housing, and thereby the effect of melting the snow or ice on the front lens can be obtained to some extent. However, the effect is not sufficient and there is room for improvement.

SUMMARY OF THE INVENTION

The present invention has been made in view of the foregoing circumstances, and one of the purposes thereof is to provide a technique in which the heat produced by the semiconductor light emitting device is diffused efficiently and the heat is effectively used for preventing the adhesion of snow or ice to the translucent cover.

To solve the foregoing problems, an embodiment of the present invention relates to an automotive lamp. The automotive lamp comprises: a lamp chamber formed so as to include a lamp body having a front end opening portion and a translucent cover provided on the lamp body so as to cover the front end opening portion; a lamp unit that is housed inside the lamp chamber and includes a semiconductor light emitting device as a light source; a support member that includes a light source mounting portion having a mounting surface for the semiconductor light emitting device and a plurality of radiating fins, thermally in contact with the light source mounting portion and arranged such that ventilation passages extend from the lamp body side toward the translucent cover, are formed, and that supports the lamp unit; and a fan that blows air such that air flows through the ventilation passages from the lamp body side toward the translucent cover.

BRIEF DESCRIPTION OF THE DRAWINGS

Embodiments will now be described, by way of example only, with reference to the accompanying drawings which are meant to be exemplary, not limiting, and wherein like elements are numbered alike in several Figures.

DETAILED DESCRIPTION OF THE INVENTION

Figure 1:
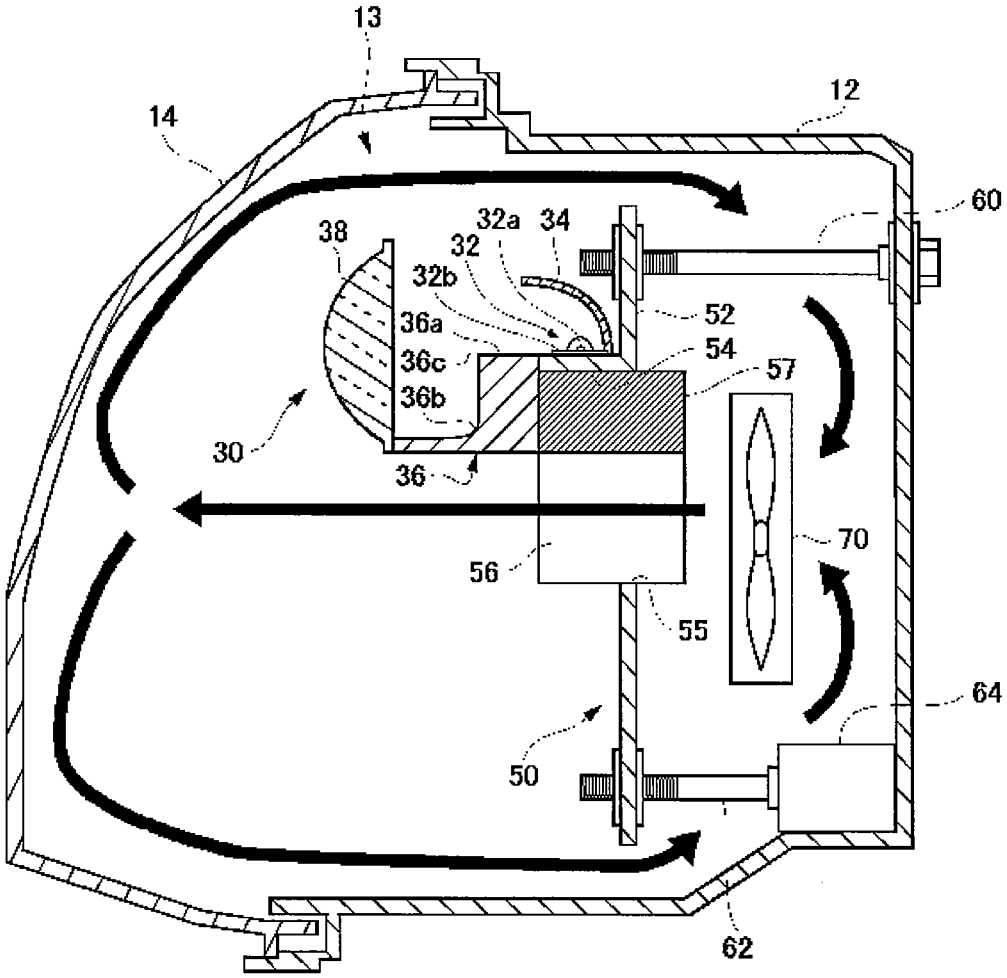
FIG. 1 is a schematic vertical cross-sectional view of an automotive lamp according to Embodiment 1.

The present invention will now be described based on preferred embodiments with reference to the accompanying drawings. The same or equivalent constituents, members, or processes illustrated in each drawing will be denoted with the same reference numerals, and the duplicative descriptions thereof are appropriately omitted. The preferred embodiments do not intend to limit the scope of the invention but exemplify the invention. All of the features and the combinations thereof described in the embodiments are not necessarily essential to the invention.

Figure 2:
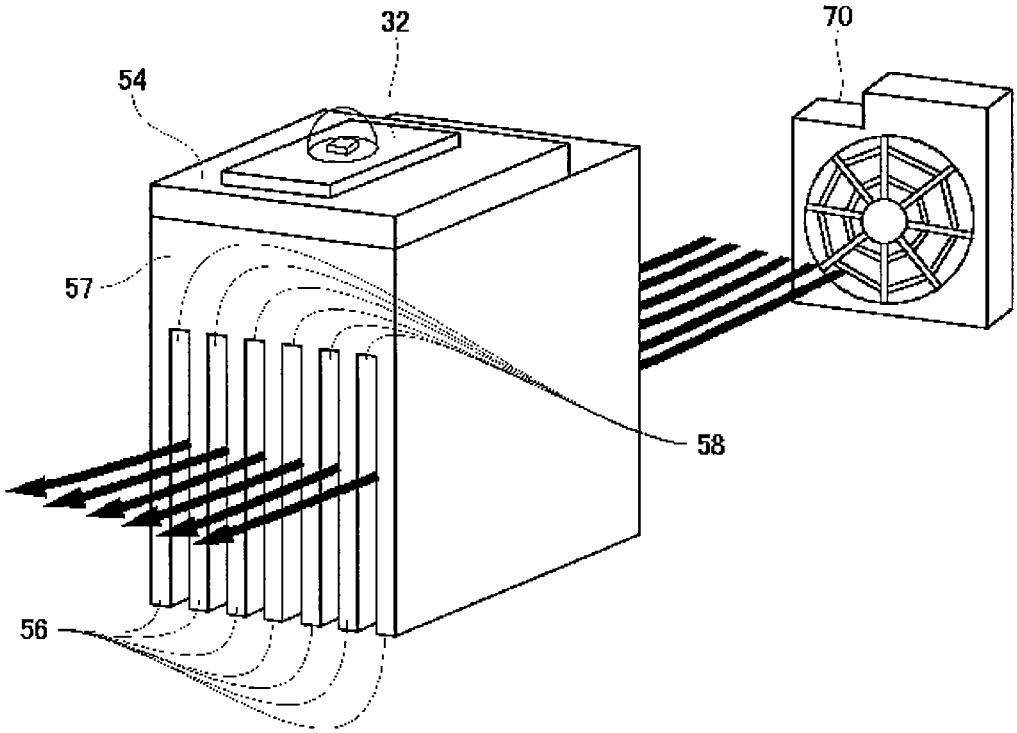
FIG. 2 is a schematic view illustrating the positional relationship between ventilation passages formed between radiating fins, and a fan.

FIG. 1 is a schematic vertical cross-sectional view of an automotive lamp according to Embodiment 1. FIG. 2 is a schematic view illustrating the positional relationship between ventilation passages formed between radiating fins, and a fan. As illustrated in FIG. 1, the automotive lamp 10 according to Embodiment 1 comprises a lamp chamber 13 formed by a lamp body 12 having a front end opening portion, and a translucent cover 14 that is formed of a translucent material and provided on the lamp body 12 so as to cover the front end opening portion. Inside the lamp chamber 13, a lamp unit 30 including a semiconductor light emitting device 32 as a light source is housed. The automotive lamp 10 also comprises a bracket 50 as a support member that supports the lamp unit 30, and a fan 70 that blows air from the lamp body 12 side toward the translucent cover 14.

The lamp unit 30 is a reflection-type and projector-type lamp unit, and includes the semiconductor light emitting device 32, a reflector 34 that reflects a light from the semiconductor light emitting device 32 in the automotive front direction, a shade 36, and a projection lens 38.

The semiconductor light emitting device 32 is, for example, an LED (light emitting device), and comprises a light emitting chip 32a covered by an approximately hemispherical cap and a thermally conductive insulating substrate 32b formed of a ceramic or the like. The light emitting chip 32*a* is arranged on the thermally conductive insulating substrate 32*b*. The semiconductor light emitting device 32 is mounted on a light source mounting portion 54 of the bracket 50, the light source mounting portion 54 being described later, in a state where the light emission direction thereof faces the approximately vertical upside which is approximately perpendicular to the light axis (left direction in FIG. 1) of the lamp unit 30. The radiation axis of the semiconductor light emitting device 32 is adjustable in accordance with its shape or distribution of light radiated forwards. The semiconductor light emitting device 32 may have a structure in which the plurality of light emitting chips 32*a* are installed.

The reflector 34 is, for example, a reflecting member in which a reflecting surface composed of part of an ellipsoid of revolution is formed on the inner surface thereof, and one end thereof is fixed to the light source mounting portion 54 of the bracket 50. The shade 36 has a planar portion 36*a* approximately horizontally arranged, and a region anterior to the planar portion 36*a* is structured as a curved portion 36*b* that is curved downwards in a concave manner, so that the light emitted by the semiconductor light emitting device 32 is not reflected. The reflector 34 is designed to be located such that the first focal point thereof is located near the semiconductor light emitting device 32, and the second focal point thereof is located near an edge line 36*c* formed by the planar portion 36*a* and the curved portion 36*b* of the shade 36.

The projection lens 38 is a plano-convex aspheric lens that projects the light reflected on the reflecting surface of the reflector 34 in the front direction of the lamp, the projection lens 38 having its front surface of a convex surface and its back surface of a planar surface. The projection lens 38 is structured such that an image on the backside focal plane is projected in the front direction of the lamp as an inverted image. The projection lens 38 is arranged on the light axis of the lamp unit 30 extending in the automotive forward-backward direction, and fixed to the tip portion on the automotive front side of the shade 36. The back focal point of the projection lens 38 is designed, for example, to be located at the approximately same position as that of the second focal point of the reflector 34.

The light emitted by the light emitting chip 32*a* of the semiconductor light emitting device 32 is reflected on the reflecting surface of the reflector 34 to enter the projection lens 38 through the second focal point of the reflector 34. The lights entered the projection lens 38 are concentrated by the projection lens 38 so as to be radiated forwards as approximately parallel lights. Part of the lights is reflected on the planar portion 36*a* with the edge line 36*c* of the shade 36 being a border line such that the light is selectively cut, forming a diagonal cut-off line in the light distribution pattern projected in the automotive front direction.

The bracket 50 comprises: an approximately plate-shaped main body 52; a light source mounting portion 54 that protrudes from one surface of the main body 52 to extend in the light axis direction of the lamp unit 30, and on a mounting surface thereof, which is located along the extending direction, the semiconductor light emitting device 32 is mounted; and radiating fins 56 for diffusing the heat produced by the semiconductor light emitting device 32.

The main body 52 is provided with through-holes at a predetermined position in the peripheral portion thereof such that the bracket 50 is fixed to the lamp body 12, with an aiming screw 60 that extends forwards penetrating the lamp body 12, and a leveling shaft 62 inserted into the through-holes of the main body 52. The leveling shaft 62 is connected to a leveling actuator 64. The automotive lamp 10 is designed such that the light axis of the lamp unit 30 is adjustable in the horizontal direction or the vertical direction by the aiming screw 60, the leveling shaft 62 and the leveling actuator 64.

The light source mounting portion 54 has the mounting surface for the semiconductor light emitting device 32, on which the device 32 is mounted. One end of the reflector 34 is fixed to the mounting surface side of the light source mounting portion 54, and the shade 36 is fixed to the end portion of the light source mounting portion 54, the end portion being on the side opposite to the main body 52.

In a downward region of the light source mounting portion 54 of the main body 52, radiating fin mounting through-holes 55 that penetrate in the automotive forward-backward direction, are provided such that the plurality of radiating fins 56 are arranged so as to penetrate the radiating fin mounting through-holes 55. In the present embodiment, as illustrated in FIGS. 1 and 2, a plate-shaped base portion 57 is arranged on a surface of the light source mounting portion 54, the surface being opposite to the mounting surface for the semiconductor light emitting device 32.

The radiating fins 56 are plate fins and are thermally in contact with the surface opposite to the mounting surface of the light source mounting portion 54 through the base portion 57. The radiating fins 56 may be provided in a protruding manner on the light source mounting portion 54 without having the base portion 57. The radiating fins 56 are arranged such that the ventilation passages 58 formed between the plurality of radiating fins 56 extend from the lamp body 12 side toward the translucent cover 14, that is, the air passing through the ventilation passages 58 is guided to the translucent cover 14. The radiating fins 56 are arranged such that the ventilation passages 58 are parallel with the mounting surface of the light source mounting portion 54. As stated above, because the radiating fins 56 are arranged so as to penetrate the radiating fin mounting through-holes 55, the ventilation passages 58 are also provided so as to penetrate the through-holes 55, allowing a space on the automotive backside of the main body 52 and a space on the automotive front side thereof to be connected together by the ventilation passages 58.

The radiating fins 56 and the base portion 57 are formed of a metal having a high thermal conductivity such as aluminum or the like, and the heat produced by the semiconductor light emitting device 32 is conducted to the light source mounting portion 54, and then conducted to the radiating fins 56 through the base portion 57. The heat conducted to the radiating fins 56 is radiated from the fins 56 into the air inside the lamp chamber 13.

In the present embodiment, the radiating fins 56 are arranged on a surface side opposite to the mounting surface of the light source mounting portion 54. That is, the radiating fins 56 are provided in a protruding manner on the surface opposite to the mounting surface of the light source mounting portion 54 through the base portion 57. Accordingly, the heat produced by the semiconductor light emitting device 32 is conducted from the light source mounting portion 54 to the radiating fins 56 arranged immediately beneath the light source mounting portion 54. Therefore, the heat produced by the semiconductor light emitting device 32 can be conducted to the radiating fins 56 more efficiently than the case where the radiating fins 56 are provided on the surface of the main body 52 opposite to the light source mounting portion 54. Furthermore, because the radiating fins 56 are provided under the light source mounting portion 54, the space on the automotive backside of the main body 52 inside the lamp chamber 13 can be omitted, allowing the automotive lamp 10 to be made thinner.

The radiating fins 56 may be formed such that each width of the ventilation passages 58 is progressively greater as advancing from the lamp body 12 side toward the translucent cover 14 side, that is, from the upstream side toward the downstream side of the air flow. When the radiating fins 56 are formed in this way, the air passing through the ventilation passages 58 is widened in the left-right direction, and hence the warmed air can be guided to a wide area of the translucent cover 14.

The fan 70 is installed on the side of the main body 52, the side being opposite to the surface on which the light source mounting portion 54 is formed, and comprises a plurality of fan blades that are rotated by a not-illustrated fan motor, and a fan casing that is a square frame covering the outer circumference of the fan 70. When the fan 70 starts rotating, the air inside the lamp chamber 13 is blown from the lamp body 12 side toward the translucent cover 14.

Subsequently, the description will be made with respect to how the convection of the air inside the automotive lamp 10 according to the present embodiment occurs. In FIGS. 1 and 2, arrows indicate the flow of air. In the automotive lamp 10, when the light emitting chip 32*a* of the semiconductor light emitting device 32 emits light, the heat resulting from the emission of light is conducted to the light source mounting portion 54 through the thermally conductive insulating substrate 32*b* with which the light emitting chip 32*a* is in contact. The heat conducted to the light source mounting portion 54 is then conducted to the base portion 57, and thereafter conducted to the radiating fins 56 through the base portion 57.

In the ventilation passages 58 formed between the plurality of radiating fins 56, the air blown by the fan 70 flows from the lamp body 12 side to the translucent cover 14 side, and heat exchange between the radiating fins 56 and the air is performed while the air blown by the fan 70 is flowing through the ventilation passages 58. Thereby, the heat conducted to the radiating fins 56 is radiated into the ambient air. Because air flows from the lamp body 12 side to the translucent cover 14 side in the ventilation passages 58, and thereby the air warmed by the radiating fins 56 does not remain there, allowing the efficiency in radiating heat from the radiating fins 56 into the ambient air to be improved.

The air warmed due to the radiation by the radiating fins 56 while passing through the ventilation passages 58, is directly blown to the translucent cover 14 from the radiating fins 56. When reaching the translucent cover 14, the air flows in the upward-downward direction along the translucent cover 14. Because the translucent cover 14 is exposed to outside, the cover 14 has a lower temperature than the air blown from the radiating fins 56. Accordingly, the air blown from the radiating fins 56 is cooled due to the heat exchange with the translucent cover 14 while the air flowing in the upward-downward direction along the translucent cover 14.

On the other hand, the translucent cover 14 is warmed by the air directly blown from the radiating fins 56. Thereby, the adhesion of snow or ice to the outer surface of the translucent cover 14 can be effectively suppressed, or the snow or ice adhered to the outer surface thereof can be effectively melted. The air cooled by the heat exchange with the translucent cover 14 flows backwards along the top surface or the bottom surface of the lamp body 12, thereafter being blown again toward the translucent cover 14 by the fan 70.

As stated above, the air warmed by the radiating fins 56 is cooled by the translucent cover 14, and the cooled air is warmed again by the radiating fins 56. Because the air inside the lamp chamber 13 is circulated in this way, the heat produced by the semiconductor light emitting device 32 can be effectively radiated. Further, the adhesion of snow or ice to the outer surface of the translucent cover 14 can be suppressed, or the snow or ice adhered to the outer surface thereof can be melted, by the heat conducted to the translucent cover 14.

Figure 3A:
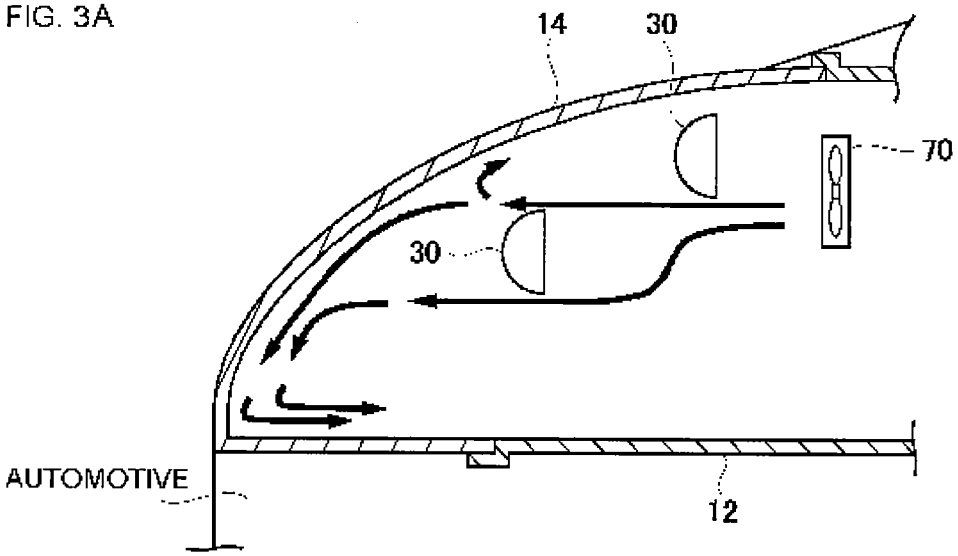
FIGS. 3A and 3B are schematic views illustrating a position where the fan is installed.
Figure 3B:
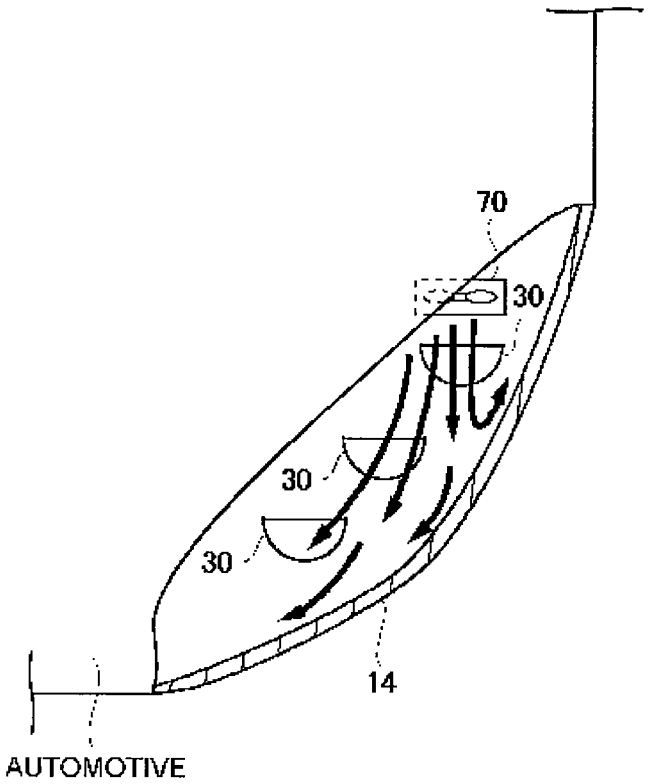

Subsequently, the description will be made with respect to a position where the fan 70 is installed in accordance with a shape of the translucent cover 14. FIGS. 3A and 3B are schematic views illustrating a position where the fan 70 is installed. As illustrated in FIG. 3A, when the translucent cover 14 extends in an inclined manner relative to the forward-backward direction of the light axis of the lamp unit 30, as seen in vertical cross section, the fan 70 is installed such that the blown air flows along the translucent cover 14 from the backside to the front side thereof, as seen in vertical cross section. That is, the fan 70 is installed toward the top and toward the back of the lamp chamber 13.

As illustrated in FIG. 3B, when the translucent cover 14 extends in an inclined manner relative to the forward-backward direction of the light axis of the lamp unit 30, as seen in horizontal cross section, the fan 70 is installed such that the blown air flows along the translucent cover 14 from the backside to the front side thereof, as seen in horizontal cross section. That is, the fan 70 is installed on the automotive outside side and on the backside of the lamp chamber 13.

As stated above, by installing the fan 70 at the position in accordance with the shape of the translucent cover 14 inside the lamp chamber 13, the air warmed by the radiating fins 56 can be blown to a wide area of the translucent cover 14 without a bias. Thereby, the heat exchange between the warmed air and the translucent cover 14 is enhanced in its efficiency, and hence the heat produced by the semiconductor light emitting device 32 can be radiated more efficiently. Further, because the air warmed by the radiating fins 56 moves along the translucent cover 14 in a longer distance, the period during the heat exchange with the translucent cover 14 is lengthened, and accordingly the air inside the lamp chamber 13 can be cooled more surely. Furthermore, an area of the translucent cover 14 capable of suppressing the adhesion of snow or ice, or an area of thereof capable of melting the adhered snow or ice, can be enlarged.

Operations and effects by the aforementioned structures will be collectively described below. In the present embodiment, the radiating fins 56 are provided such that the ventilation passages 58 extend from the lamp body 12 side toward the translucent cover 14. And, the air is blown through the ventilation passages 58 from the lamp body 12 side to the translucent cover 14 side, by the fan 70. The air warmed due to the heat produced by the semiconductor light emitting device 32 is cooled by the translucent cover 14, and thereafter the cooled air is warmed again due to the heat produced by the semiconductor light emitting device 32. Because the air inside the lamp chamber 13 is circulated in this way, the heat produced by the semiconductor light emitting device 32 can be radiated efficiently.

In this case, because the air warmed by the heat exchange with the radiating fins 56 is blown to the translucent cover 14 side without remaining near the radiating fins 56, the heat produced by the semiconductor light emitting device 32 can be diffused efficiently. Further, because the air warmed by the radiating fins 56 is directly blown to the translucent cover 14 from the radiating fins 56, the translucent cover 14 can be warmed efficiently, allowing the heat produced by the semiconductor light emitting device 32 to be effectively used for preventing the adhesion of snow or ice to the translucent cover 14. Thereby, the forward visibility and running safety in winter or in cold regions, etc., can be ensured.

When the radiating fins 56 are installed on the surface side opposite to the mounting surface of the light source mounting portion 54, the heat produced by the semiconductor light emitting device 32 is conducted from the light source mounting portion 54 to the radiating fins 56, which are arranged directly beneath the portion 54, and hence the heart produced by the device 32 can be conducted to the radiating fins 56 more efficiently. Furthermore, the space on the automotive backside of the main body 52 inside the lamp chamber 13 can be omitted, allowing the automotive lamp 10 to be made thinner.

When the radiating fins 56 are formed such that each width of the ventilation passages 58 is progressively greater as advancing from the body 12 side toward the translucent cover 14 side, the warmed air can be guided to a wide area of the translucent cover 14. Thereby, the heat exchange between the warmed air and the translucent cover 14 is enhanced in its efficiency, and hence the heat produced by the semiconductor light emitting device 32 can be radiated efficiently. Furthermore, an area of the translucent cover 14 capable of suppressing the adhesion of snow or ice, or an area thereof capable of melting the adhered snow or ice, can be enlarged.

When the fan 70 is installed such that the blown air flows along the translucent cover 14 from the backside to the front side thereof, as seen in vertical or horizontal cross section, in the case where the translucent cover 14 is inclined relative to the forward-backward direction of the light axis of the lamp unit 30, as seen in vertical or horizontal cross section, the warmed air can be blown to a wide area of the translucent cover 14 without a bias. Thereby, the heat produced by the semiconductor light emitting device 32 can be radiated more efficiently. In addition, because the air warmed by the radiating fins 56 moves along the translucent cover 14 in a longer distance, the air inside the lamp chamber 13 can be cooled more surely. Furthermore, an area of the translucent cover 14 capable of suppressing the adhesion of snow or ice, or an area of thereof capable of melting the adhered snow or ice, can be enlarged.

An automotive lamp according to Embodiment 2 is different from that of Embodiment 1 in that a first lamp unit and a second lamp unit are installed inside a lamp chamber and these lamp units use radiating fins in common. Hereinafter, the present embodiment will be described. Other structures of the automotive lamp are the same as those of Embodiment 1, and such structures are denoted with the same reference numerals and descriptions with respect thereto are omitted.

Figure 4:
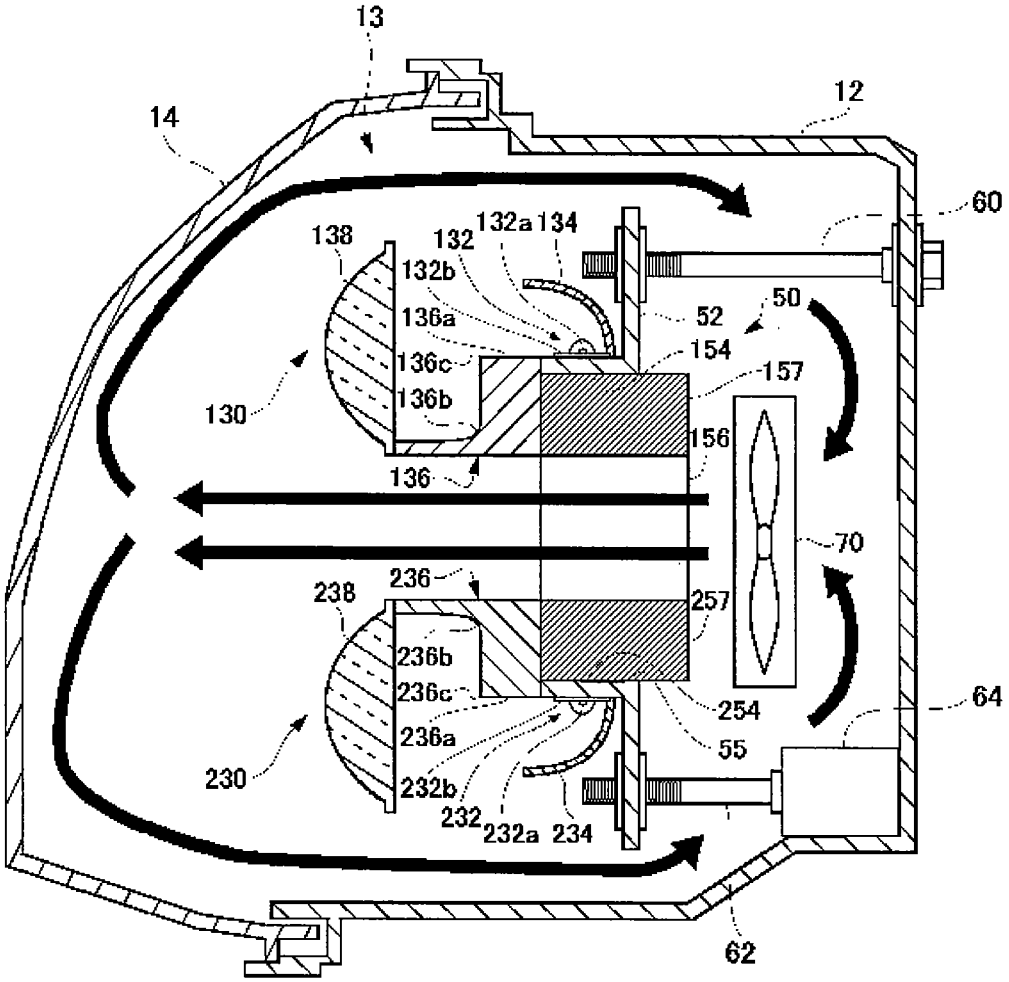
FIG. 4 is a schematic vertical cross-sectional view of an automotive lamp according to Embodiment 2.

FIG. 4 is a schematic vertical cross-sectional view of the automotive lamp according to Embodiment 2. As illustrated in FIG. 4, the automotive lamp 10 according to Embodiment 2 has a structure in which a first lamp unit 130 including a semiconductor light emitting device 132 and a second lamp unit 230 including a semiconductor light emitting device 232 are housed in a lamp chamber 13 formed by a lamp body 12 and a translucent cover 14. The automotive lamp 10 comprises a bracket 50 that supports the first lamp unit 130 and the second lamp unit 230, and a fan 70 that blows air from the lamp body 12 side toward the translucent cover 14.

The first lamp unit 130 is a reflection-type and projector-type lamp unit, and includes the semiconductor light emitting device 132, a reflector 134, a shade 136 and a projection lens 138. Likewise, the second lamp unit 230 is a reflection-type and projector-type lamp unit, and includes the semiconductor light emitting device 232, a reflector 234, a shade 236 and a projection lens 238.

The semiconductor light emitting devices 132 and 232 comprise light emitting chips 132*a* and 232*a*, and thermally conductive insulating substrates 132*b* and 232*b*, respectively. The semiconductor light emitting device 132 is mounted on a first light source mounting portion 154 of the bracket 50, the light source mounting portion 154 being described later, in a state where the light emission direction thereof faces the approximately vertical upside which is approximately perpendicular to the light axis (left direction in FIG. 4) of the first lamp unit 130. The semiconductor light emitting device 232 is mounted on a second light source mounting portion 254 of the bracket 50, the light source mounting portion 254 being described later, in a state where the light emission direction thereof faces the approximately vertical downside which is approximately perpendicular to the light axis (left direction in FIG. 4) of the second lamp unit 230.

One end of each of the reflectors 134 and 234 is fixed to each of the first light source mounting portion 154 and the second light source mounting portion 254. The shades 136 and 236 include planar portions 136*a* and 236*a*, curved portions 136*b* and 236*b* and edge lines 136*c* and 236*c*, respectively. The reflectors 134 and 234 are designed to be located such that the first focal points thereof are located near the semiconductor light emitting devices 132 and 232, and the second focal points thereof are located near the edge lines 136*c* and 236*c*.

The projection lenses 138 and 238 are plano-convex aspheric lenses having their front surfaces of convex surfaces and their back surfaces of planar surfaces, respectively. Each of the lenses 138 and 238 is arranged on each of the light axes of the first lamp unit 130 and the second lamp unit 230, and fixed to each of the tip portions on the automotive front sides of the shades 136 and 236. The back focal points of the projection lenses 138 and 238 are designed to be located at the approximately same positions as those of the second focal points of the reflectors 134 and 234.

The bracket 50 comprises: an approximately plate-shaped main body 52; the first light source mounting portion 154 that protrudes from one surface of the main body 52 to extend in the light axis direction of the first lamp unit 130, on which the semiconductor light emitting device 132 is mounted; and the second light source mounting portion 254 that protrudes from one surface of the main body 52 to extend in the light axis direction of the second lamp unit 230, on which the semiconductor light emitting device 232 is mounted. The bracket 50 also comprises radiating fins 156 for diffusing the heat produced by the semiconductor light emitting devices 132 and 232.

The bracket 50 is fixed to the lamp body 12, with an aiming screw 60 and a leveling shaft 62 that is connected to a leveling actuator 64 inserted into through-holes provided in the main body 52. The first light source mounting portion 154 has a mounting surface for the semiconductor light emitting device 132, on which the device 132 is mounted. The second light source mounting portion 254 has a mounting surface for the semiconductor light emitting device 232, on which the device 232 is mounted.

In a region between the first light source mounting portion 154 and the second light source mounting portion 254 in the main body 52, radiating fin mounting through-holes 55 that penetrate in the automotive forward-backward direction, are provided such that the plurality of radiating fins 156 are arranged so as to penetrate the radiating fin mounting through-holes 55. In the present embodiment, a first base portion 157 is arranged on a surface of the first light source mounting portion 154, the surface being opposite to the mounting surface thereof, while a second base portion 257 is arranged on a surface of the second light source mounting portion 254, the surface being opposite to the mounting surface thereof.

One end of the radiating fins 156 is thermally in contact with the surface opposite to the mounting surface of the first light source mounting portion 154, through the first base portion 157, while the other end thereof is thermally in contact with the surface opposite to the mounting surface of the second light source mounting portion 254, through the second base portion 257. The radiating fins 156 may be provided in a protruding manner directly on the first light source mounting portion 154 and the second light source mounting portion 254 without having the first base portion 157 and the second base portion 257. The radiating fins 156 may have a structure in which at least part of one end region thereof is thermally in contact with the first light source mounting portion 154, and at least part of the other end region thereof is thermally in contact with the second light source mounting portion 254. When the radiating fins 156 is provided in a protruding manner on the first and the second light source mounting portions 154 and 254 through the first and the second base portions 157 and 257, at least part of the first base portion 157 and at least part of the second base portion 257 may be in contact with the first and the second light source mounting portions 154 and 254, respectively.

The radiating fins 156 are arranged such that the ventilation passages formed between the plurality of radiating fins 156 extend from the lamp body 12 side toward the translucent cover 14, in the same way as Embodiment 1. The radiating fins 156 are arranged such that the ventilation passages are parallel with the mounting surfaces of the first and the second light source mounting portions 154 and 254. The radiating fins 156 may be formed such that each width of the ventilation passages is progressively greater as advancing from the lamp body 12 side toward the translucent cover 14 side.

The fan 70 is installed on the side of the main body 52, the side being opposite to the surfaces on which the first and the second light source mounting portions 154 and 254 are formed.

Subsequently, the description will be made with respect to how the convection of the air inside the automotive lamp 10 according to the present embodiment occurs. In FIG. 4, arrows indicate the flow of air. In the automotive lamp 10, the heat produced by the semiconductor light emitting device 132 is conducted to the first light source mounting portion 154. The heat conducted to the first light source mounting portion 154 is then conducted to the radiating fins 156 through the first base portion 157. The heat produced by the semiconductor light emitting device 232 are conducted to the second light source mounting portion 254. The heat conducted to the second light source mounting portion 254 is then conducted to the radiating fins 156 through the second base portion 257.

In the ventilation passages formed between the plurality of radiating fins 156, the air blown by the fan 70 flows from the lamp body 12 side to the translucent cover 14 side, and the heat exchange with the radiating fins 156 is performed while the air blown by the fan 70 is flowing through the ventilation passages. Thereby, the heat conducted to the radiating fins 156 is radiated into the ambient air.

The air warmed due to the radiation by the radiating fins 156 while passing through the ventilation passages, is directly blown to the translucent cover 14 from the radiating fins 156. When reaching the translucent cover 14, the air flows in the upward-downward direction along the translucent cover 14. The air blown from the radiating fins 156 is cooled due to the heat exchange with the translucent cover 14 while the air is flowing in the upward-downward direction along the translucent cover 14.

On the other hand, the translucent cover 14 is warmed by the air blown from the radiating fins 156. Thereby, the adhesion of snow or ice to the outer surface of the translucent cover 14 can be suppressed, or the snow or ice adhered to the outer surface thereof can be melted. The air cooled by the heat exchange with the translucent cover 14 flows backwards along the top surface or the bottom surface of the lamp body 12, thereafter being blown again toward the translucent cover 14 by the fan 70.

Operations and effects by the aforementioned structures will be collectively described below. In the present embodiment, one end of the radiating fins 156 is in contact with the first light source mounting portion 154 through the first base portion 157, while the other end thereof is in contact with the second light source mounting portion 254 through the second base portion 257. The heat produced by the semiconductor light emitting devices 132 and 232 are radiated into the air flowing through the ventilation passages in the radiating fins 156. That is, the first lamp unit 130 and the second lamp unit 230 use the radiating fins 156 in common.

Therefore, the following effects can be obtained in addition to the effects obtained by the aforementioned Embodiment 1. That is, it is not required that each of the first lamp unit 130 and the second lamp unit 230 is provided with the radiating fins 156, and hence the space for mounting the radiating fins 156 can be reduced, allowing the automotive lamp 10 to be further miniaturized. Furthermore, because increase in the number of parts can be suppressed, the cost of the automotive lamp 10 can be reduced.

It is noted that the present invention should not be limited to the aforementioned embodiments, and various variations such as design modifications or the like may be made thereto based on knowledge of a person skilled in the art, and embodiments including such variations should be encompassed by the present invention.

For example, in the aforementioned embodiment, an LED is used as a light source; however, a semiconductor light emitting device, for example, a semiconductor laser or the like, can be used. Also, in the aforementioned embodiment, a projector-type lamp unit is used as a lamp unit; however, a parabolic-type or direct-emitting type lamp unit can be used.

Figure 5:
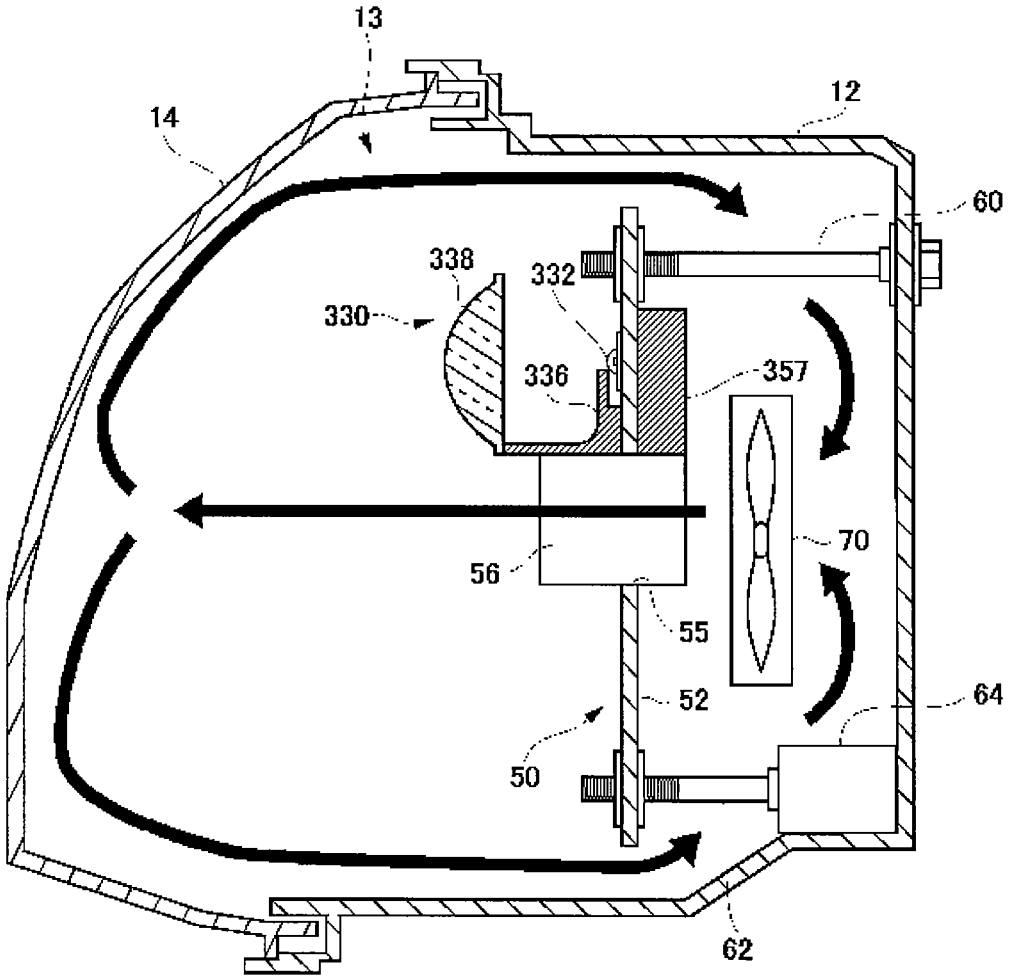
FIG. 5 is a schematic vertical cross-sectional view of an automotive lamp comprising a direct-emitting type lamp unit.

FIG. 5 is a schematic vertical cross-sectional view of the automotive lamp 10 comprising a direct-emitting type lamp unit. As illustrated in FIG. 5, the automotive lamp 10 comprises a lamp unit 330 that is a direct-emitting type and projector-type lamp unit. The lamp unit 330 comprises a semiconductor light emitting device 332, a shade 336 and a projection lens 338. The semiconductor light emitting device 332 is mounted on the main body 52 of the bracket 50 in a state where the light emission direction thereof faces the light axis direction (left direction in FIG. 5) of the lamp unit 330. Accordingly, the light source mounting portion is composed of part of the main body 52.

A base portion 357 is arranged on the surface of the main body 52 of the bracket 50, the surface being opposite to the semiconductor light emitting device 332. The lower end of the base portion 357 is connected to the plurality of radiating fins 56, which are arranged so as to penetrate the radiating fin mounting through-holes 55. Accordingly, the heat produced by the semiconductor light emitting device 332 is conducted to the radiating fins 56 through the base portion 357. The bracket 50 may not comprise the base portion 357, but the upper end of the radiating fins 56 may extend to the area where the base portion 357 might exist and be in contact with the light source mounting portion.

In the aforementioned embodiments, the lamp units 30, 130 and 230 are lamp units for low-beam emission in which a diagonal cut-off line is formed in the light distribution pattern; however, those lamp units may be ones for high-beam emission in which a diagonal cut-off line is not formed.

The automotive lamps 10 according to the aforementioned embodiments can be applied to, for example, automotive headlamps, tail lamps, or auxiliary headlamps such as fog lamps, driving lamps or the like.

What is claimed is:

1. An automotive lamp comprising:

a lamp chamber formed so as to include a lamp body having a front end opening portion and a translucent cover provided on the lamp body so as to cover the front end opening portion;

a first lamp unit that is housed inside the lamp chamber and that includes a first semiconductor light emitting device as a light source;

a second lamp unit that is housed inside the lamp chamber and that includes a second semiconductor light emitting device as a light source;

a support member that includes a first light source mounting portion having a first mounting surface for the first semiconductor light emitting device, a second light source mounting portion that has a second mounting surface for the second semiconductor light emitting device, and a plurality of radiating fins having two opposing ends connected in thermal communication between said first and second light source mounting portions and arranged such that a plurality of ventilation passages extending in a direction from the lamp body toward the translucent cover are formed in the lamp chamber, wherein at least part of one of said two opposing ends of the plurality of radiating fins is in contact with the first light source mounting portion via a first base portion or directly, and at least part of the other of said two opposing ends of the plurality of radiating fins is in contact with the second light source mounting portion via a second base portion or directly, the support member supporting the first lamp unit and the second lamp unit; and a fan positioned between said lamp body and said plurality of radiating fins, said fan being configured to blow air through the plurality of ventilation passages in a direction from the lamp body toward the translucent cover, wherein the first and second light source mounting portions are arranged such that a first rear surface of the first light source mounting portion opposite to the first mounting surface and a second rear surface of the second light source mounting portion opposite to the second mounting surface face each other, wherein the plurality of radiating fins are arranged between the first rear surface and the second rear surface facing each other, one of said two opposing ends of said plurality of radiating fins being in contact with the first rear surface via the first base portion or directly, and the other of said two opposing ends of said plurality of radiating fins being in contact with the second rear surface via the second base portion or directly, wherein the support member is provided with a through hole between the first and second light source mounting portions, wherein the plurality of ventilation passages are provided between the first and second light source mounting portions, and wherein the automotive lamp is configured such that the air blown from the fan reaches the translucent cover via the through hole and the plurality of ventilation passages.

2. The automotive lamp according to claim 1, wherein said first and second lamp units are oriented to face in a light axis direction extending from the lamp body toward the translucent cover, wherein the first and second light source mounting portions extend in the light axis direction of the first and second lamp units, and wherein the radiating fins are arranged such that the ventilation passages are parallel with the first and second mounting surfaces.

3. The automotive lamp according to claim 2, wherein the radiating fins are arranged on the surface sides opposite to the first and second mounting surfaces of the first and second light source mounting portions.

4. The automotive lamp according to claim 2, wherein the translucent cover extends in an inclined manner relative to the direction of the light axis of the lamp unit, as seen in vertical cross section, and wherein the fan is installed such that the blown air flows along the translucent cover from a backside to a front side, as seen in vertical cross section.

5. The automotive lamp according to claim 2, wherein the translucent cover extends in an inclined manner relative to the light axis of the lamp unit, as seen in horizontal cross section, and wherein the fan is installed such that the blown air flows along the translucent cover from a backside to a front side, as seen in horizontal cross section.

6. The automotive lamp according to claim 1, wherein the first light source mounting portion and the second light source mounting portion are arranged across the radiating fins.

7. An automotive lamp comprising:

a lamp chamber formed so as to include a lamp body having a front end opening portion and a translucent cover provided on the lamp body so as to cover the front end opening portion;

a first lamp unit that is housed inside the lamp chamber and that includes a first semiconductor light emitting device as a light source;

a second lamp unit that is housed inside the lamp chamber and that includes a second semiconductor light emitting device as a light source;

a support member that includes a first light source mounting portion, a second light source mounting portion, and a plurality of radiating fins, each of said plurality of radiating fins being connected in thermal communication between said first and second light source mounting portions, said first light source mounting portion having a first mounting surface for the first semiconductor light emitting device, said second light source mounting portion having a second mounting surface for the second semiconductor light emitting device, said plurality of radiating fins defining a plurality of ventilation passages extending in a direction from said lamp body toward said translucent cover; and a fan positioned between said lamp body and said plurality of radiating fins, said fan being configured to blow air inside the lamp chamber through the plurality of ventilation passages in a direction from the lamp body toward the translucent cover, wherein a positional relationship between the radiating fins and the fan is determined such that heat produced by the semiconductor light emitting device is conducted to the translucent cover, wherein the first and second light source mounting portions are arranged such that a first rear surface of the first light source mounting portion opposite to the first mounting surface and a second rear surface of the second light source mounting portion opposite to the second mounting surface face each other, wherein the plurality of radiating fins are arranged between the first rear surface and the second rear surface facing each other, one of two opposing ends of each of said plurality of radiating fins being in contact with the first rear surface via a first base portion or directly, and the other of said two opposing ends of each of said plurality of radiating fins being in contact with the second rear surface via a second base portion or directly, wherein the support member is provided with a through hole between the first and second light source mounting portions, wherein the plurality of ventilation passages are provided between the first and second light source mounting portions, and wherein the automotive lamp is configured such that the air blown from the fan reaches the translucent cover via the through hole and the plurality of ventilation passages.

8. An automotive lamp comprising:

a lamp chamber formed so as to include a lamp body having a front end opening portion and a translucent cover provided on the lamp body so as to cover the front end opening portion;

a first lamp unit that is housed inside the lamp chamber and includes a first semiconductor light emitting device as a light source;

a second lamp unit that is housed in the lamp chamber and that includes a second semiconductor light emitting device as a light source;

a plurality of radiating fins, each of said plurality of radiating fins being connected in thermal communication between the first lamp unit and the second lamp unit; and a support member that includes a first light source mounting portion having a first mounting surface for the first semiconductor light emitting device and a second light source mounting portion that has a second mounting surface for the second semiconductor light emitting device, the support member supporting the first lamp unit and the second lamp unit;

wherein the first and second light source mounting portions are arranged such that a first rear surface of the first light source mounting portion opposite to the first mounting surface and a second rear surface of the second light source mounting portion opposite to the second mounting surface face each other, wherein the plurality of radiating fins are arranged between the first rear surface and the second rear surface facing each other, one of two opposing ends of each of said plurality of radiating fins being in contact with the first rear surface via a first base portion or directly, and the other of said two opposing ends of each of said plurality of radiating fins being in contact with the second rear surface via a second base portion or directly, wherein the support member is provided with a through hole between the first and second light source mounting portions, wherein the plurality of ventilation passages are provided between the first and second light source mounting portions, and wherein the automotive lamp is configured such that the air blown from the fan reaches the translucent cover via the through hole and the plurality of ventilation passages.

9. The automotive lamp according to claim 8, further comprising a fan positioned between said lamp body and said plurality of radiating fins, said fan being configured to blow air through a plurality of ventilation passages defined by said plurality of radiating fins in a direction from the lamp body toward the translucent cover.

* * * * *